United States Patent [19]

Barker

[11] Patent Number: 4,556,364

[45] Date of Patent: Dec. 3, 1985

[54] CENTRIFUGAL PUMPS

[75] Inventor: Michael D. Barker, Hunsdon, Nr. Ware, England

[73] Assignee: D. Wickham and Company Limited, Hertfordshire, England

[21] Appl. No.: 400,210

[22] Filed: Jul. 21, 1982

[30] Foreign Application Priority Data

Jul. 23, 1981 [GB] United Kingdom ..... 8122798

[51] Int. Cl.[4] ..... F04D 17/08

[52] U.S. Cl. ..... 415/170 A; 415/9; 415/206; 415/219 C; 416/174

[58] Field of Search ..... 415/170 A, 206, 219 C, 415/196, 9, 88; 416/174, 224, 225

[56] References Cited

U.S. PATENT DOCUMENTS

| | | | |
|---|---|---|---|
| 1,034,456 | 8/1912 | Hurst | 416/224 |
| 1,525,884 | 12/1921 | Plummer | 415/196 |
| 1,891,267 | 12/1932 | Milkowski | 415/196 |
| 3,402,671 | 9/1968 | Wilfley | 415/170 A |
| 3,782,851 | 1/1974 | Hackbarth . | |
| 3,856,434 | 12/1974 | Hoffmann | 416/224 |
| 3,881,840 | 5/1975 | Bunjes | 415/170 A |
| 4,063,846 | 12/1977 | Eagle | 415/170 A |
| 4,076,450 | 2/1978 | Ross | 415/170 A |

FOREIGN PATENT DOCUMENTS

| | | | |
|---|---|---|---|
| 786795 | 9/1935 | France | 415/196 |
| 425652 | 10/1947 | Italy | 415/170 A |
| 150460 | 9/1920 | United Kingdom | 415/170 A |
| 594570 | 6/1944 | United Kingdom . | |
| 694637 | 3/1951 | United Kingdom . | |
| 1021667 | 10/1962 | United Kingdom . | |
| 1011948 | 8/1964 | United Kingdom . | |
| 1081163 | 8/1964 | United Kingdom . | |
| 1145895 | 8/1967 | United Kingdom . | |
| 918559 | 7/1980 | U.S.S.R. | 415/170 A |

*Primary Examiner*—Samuel Scott
*Assistant Examiner*—Brian J. Bowman
*Attorney, Agent, or Firm*—Robert T. Gammons

[57] ABSTRACT

A centrifugal pump comprises an impeller which rotates at the center of a volute casing. The open side of the casing is closed by means of a wear plate which is fixed relative to the casing and which has a central inlet opening. The impeller includes a rear plate and a plurality of curved blades radiating from an open central portion of the rear plate. An annular plate is fixed to the outermost edges of the blades at the inlet side of the impeller. A cylindrical sleeve extends in an axial direction from near the inner edge of the annular plate through the opening in the wear plate. The annular plate and sleeve protect the edge of the wear plate and impede grit and sand entering between the annular plate and around the opening and the wear plate causing wear when the pump is used to pump slurry containing grit or sand.

20 Claims, 5 Drawing Figures

CENTRIFUGAL PUMPS

BACKGROUND OF THE INVENTION

The invention relates to centrifugal pumps, in particular, to open-impeller centrifugal pumps.

In general, such pumps comprise a driven impeller which rotates in the centre of a spiral or volute casing. The impeller may comprise a circular plate which carries a number of blades or vanes which extend outwardly from an open central area on the plate. The side of the impeller opposite the plate is open to communicate with an inlet opening in the casing.

When the impeller is driven, the rotation of the blades forces the water in the central area of the impeller outwards into the spiral casing, creating suction at the central area which draws in water along an axial direction through the inlet into the impeller.

An annular wear plate is fixed on the inside of the casing around the inlet opening and fits close against the edges of the impeller blades. The clearance between the wear plate and the impeller blades is very small and, as the impeller rotates, the edges of the impeller blades pass over the surface of the wear plate. When the pump is used to raise slurry containing sand or grit, the motion of the impeller blades over the wear plate grinds the particles suspended in the slurry into the edge of the wear plate causing wear around the inlet opening.

As the edge of the wear plate becomes worn, the clearance between the impeller blades and the wear plate increases and the pump becomes less efficient because water is able to flow back towards the centre of the impeller around the edges of the impeller blades. However, the main problem arises when the pump is started up. For convenience, such pumps are usually positioned above the level of the water being pumped and must, therefore, be capable of generating sufficient suction, when the operation begins, to raise water by a distance of several feet. Initially, the pump casing may be empty of water in which case the pump is primed by pouring water into the casing through the outlet. The clearance between the impeller blades and the wear plate is very small, for example, of the order of 0.015" (0.4 mm), so that the pump can build up a pressure difference between the inlet and the outlet sufficient to draw water into the casing. As the edge of the wear plate becomes worn, this clearance increases until the leakage of water around the edges of the impeller blades prevents the pump creating sufficient suction to draw water up to the level of the pump. When this happens, the surface of the wear plate must be refaced or the entire wear plate must be replaced. This makes such pumps relatively expensive to maintain.

These problems can be avoided to a certain extent by using a closed impeller pump in which the impeller blades extend between two parallel discs provided with inlet openings. However, such pumps are generally more expensive than open-impeller pumps and, furthermore, in some circumstances, an open-impeller is more efficient. For example, when pumping sewage or stringy substances, such as water containing weed, which do not contain abrasive solids, the chopping action of the blades of an open-impeller helps to prevent the pump becoming clogged.

Various attempts have been made to overcome the need for frequent replacement of the wear plate in open-impeller pumps. For example, the wear plate may be faced with hard tool steel. Although, the steel resists wear, it is so hard that it must be ground to produce a flat, even surface. This makes the manufacture of such wear plates expensive.

Alternatively, the edge of the wear plate around the inlet opening may be faced with a high-quality hard-wearing rubber. Although this is relatively cheap, rubber-faced wear-plates last only slightly longer than conventional wear plates of plastics or synthetic rubber. In tests in which a centrifugal pump of known type was operated continuously to draw a slurry of sand-gravel and water to a height of fifteen feet, the self-priming ability of the pump was tested at intervals. A pump having a conventional wear plate of hard plastics material (polyurethane) became unable to draw water into the pump when re-started after a period of 4½ hours. A pump with a high quality Buna-N type rubber-faced wear plate lost its ability to draw water to a height of fifteen feet after 9½ hours.

In some existing forms of closed impeller pumps, a seal is formed between two closely-spaced cylindrical surfaces, one surface being provided on the inlet to the impeller and the other being provided on a sleeve integral with the casing and surrounding the inlet. However, when such pumps are used to pump gritty slurries, there is a tendency for abrasive particles to become trapped in the seal and, because the radius of the seal is relatively small, the centrifugal force at the seal is insufficient to throw the particles clear of the seal. Further, as the interface between the surfaces extends parallel to the axis of rotation the centrifugal force does not act in a direction to throw gritty substances out of the seal. In addition, with this arrangement the closed impeller cannot easily be replaced with an open impeller when stringy substances are to be pumped.

It is an object of the invention to provide a centrifugal pump which is capable of pumping gritty slurries and which avoids the need for frequent replacement of the wear plate.

It is a further object of the invention to provide a centrifugal pump which is capable of pumping gritty slurries but which can be modified to pump stringy liquids merely by replacing the impeller.

BRIEF DESCRIPTION OF THE INVENTION

The invention comprises a centrifugal pump including a pump casing having a wall, an inlet aperture in said wall and an outlet; an impeller mounted for rotation within said casing and having an opening at one side opposite said aperture. An annular plate is mounted to said impeller at said one side. A first annular sealing surface on the inside of said casing wall surrounding said inlet aperture and a second annular sealing surface on the annular plate opposite are closely spaced to impede the flow of the pumping medium. A tubular sleeve extends from said annular plate through said inlet aperture and is located radially inwardly of said sealing surfaces.

The impeller is operable to draw the pumping medium into the casing through said sleeve and said impeller opening and discharge it through said casing outlet. The close spacing of said first and second sealing surfaces impedes the flow of medium radially inwardly between said impeller and said casing.

In a preferred embodiment, the pump further includes shroud means surrounding said inlet aperture and extending over the end of the sleeve remote from said impeller to impede the flow of medium between said casing and said sleeve.

With this kind of pump, the water or slurry being pumped is drawn into the impeller through the sleeve. In the prior open impeller arrangement described above, most wear occurs where the slurry is forced to change direction through an angle of 90° as it is swept radially outwards by the impeller blades. However, in the present invention the blades are fixed relative to the annular plate of the impeller and the sleeve tends to prevent slurry flowing between the annular plate and the casing. Thus, the wear is greatly reduced because grinding of the grit into the casing is avoided. Furthermore, the shroud prevents grit suspended in the slurry travelling along the outside of the impeller sleeve and becoming trapped between the sealing surfaces formed on the casing and the annular plate of the impeller where it would grind away the surface of the casing around the inlet opening Since the seal is formed by the small clearance between the radial surface of the annular plate and the radial surface of casing wall around the inlet aperture, the centrifugal force at the outer periphery of the seal is far greater than that in a conventional cylindrical seal. Consequently, any abrasive material which enters the seal tends to be thrown clear of the seal at its outer edge rather than remaining between the sealing surfaces. Preferably the sealing surfaces extend from the outer margin of the impeller, to the sleeve so that the maximum area available is used for the seal.

A pump including a modified impeller and shroud in accordance with the invention was tested under the conditions described above and was still capable of drawing slurry to a height of fifteen feet after 70 hours of operation.

BRIEF DESCRIPTION OF THE DRAWINGS

Two embodiments of the invention will now be described in detail, by way of example, with reference to the accompanying drawings, in which.

Figure 1:
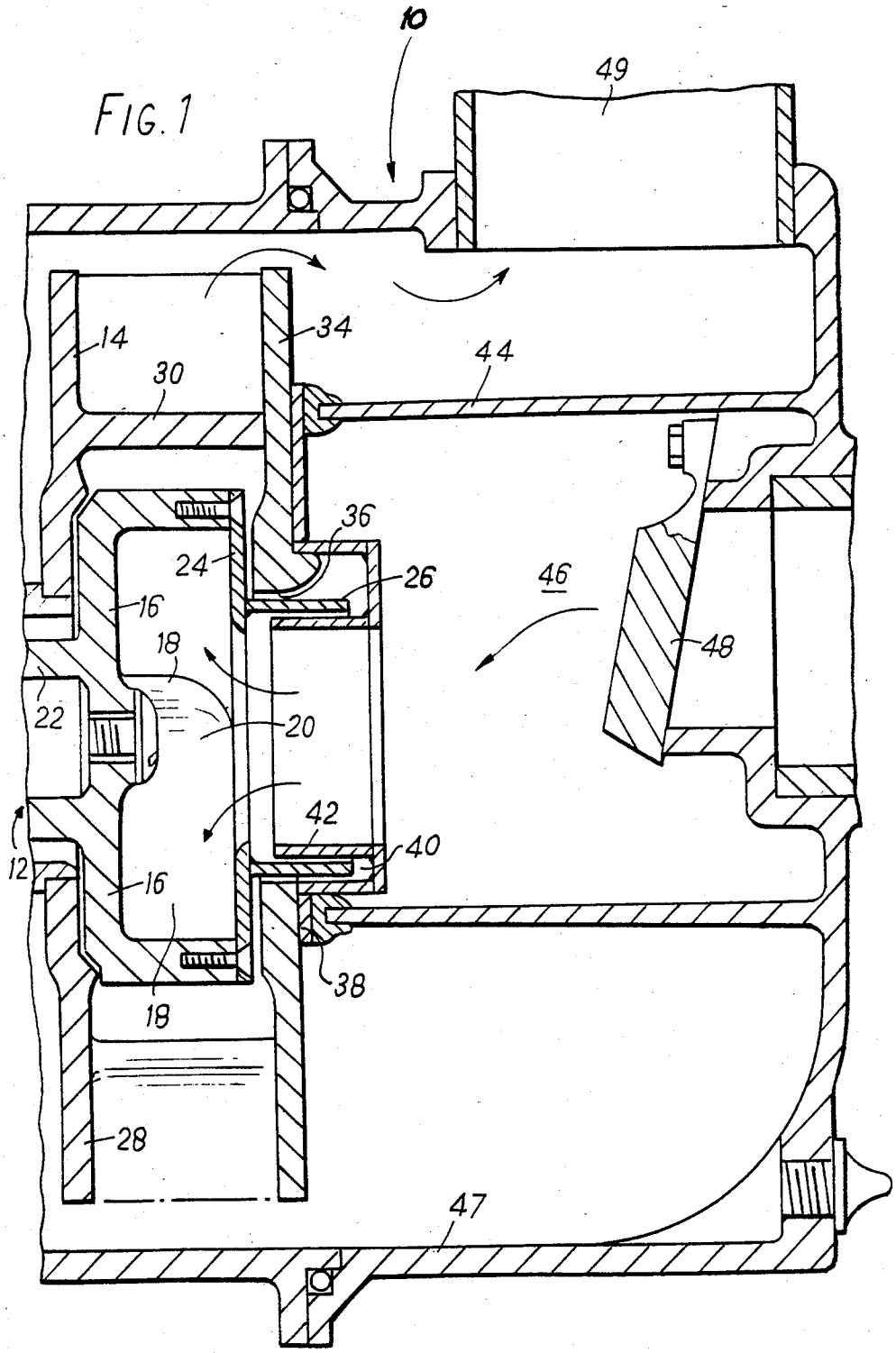
FIG. 1 is a cross-section taken along the axis of a centrifugal pump in accordance with the invention.
Figure 2:
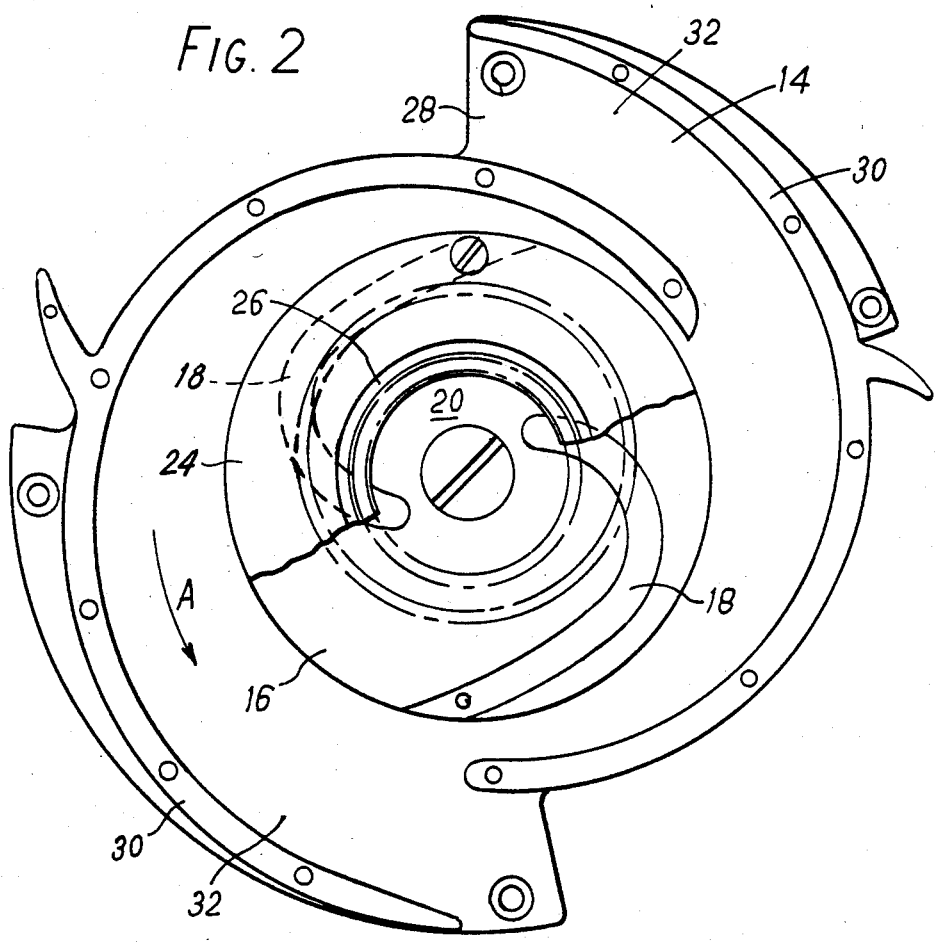
FIG. 2 is a view taken from the right as seen in FIG. 1 of the volute and impeller of the pump.
Figure 3:
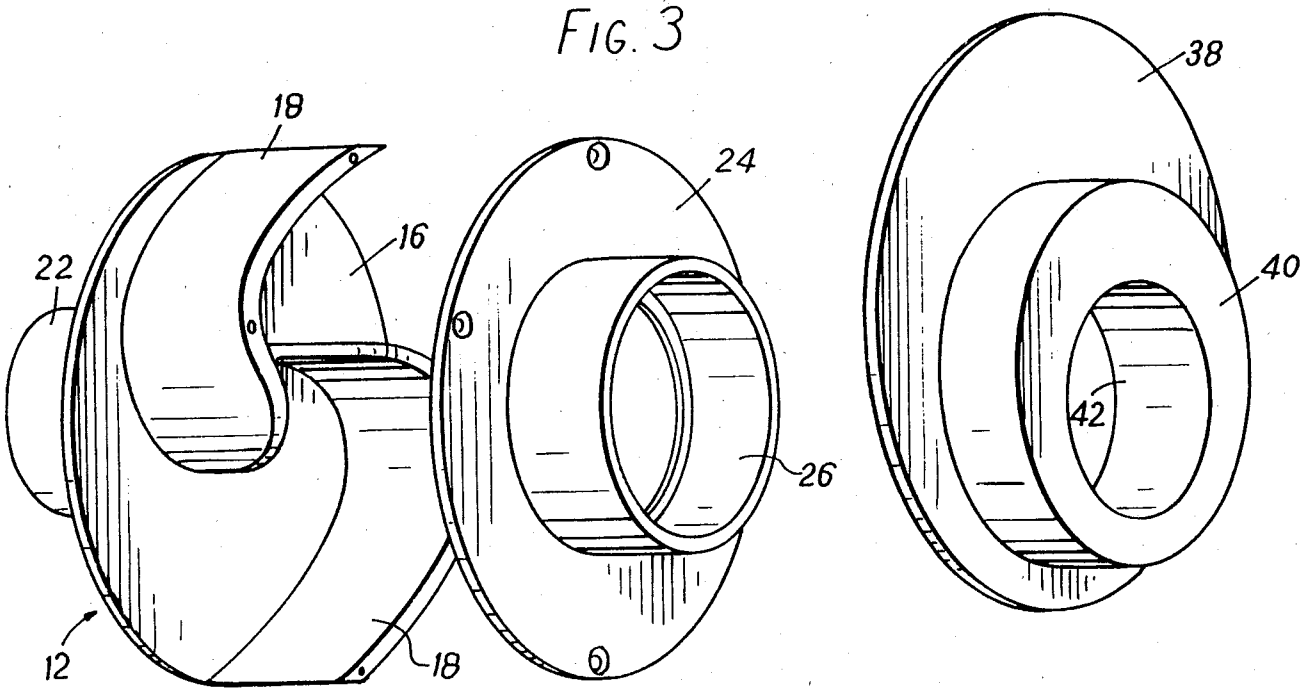
FIG. 3 is an exploded view of the impeller, and shroud of the pump of FIG. 1.

The centrifugal pump 10 shown in FIGS. 1 to 3 comprises an impeller 12 which is mounted for rotation at the centre of a spiral casing or volute 14.

The impeller 12 comprises a rear plate 16 and a plurality of curved blades 18 which radiate from an open central portion 20 of the plate 16. At the back of the plate 16 is a shaft 22 for connection to a motor (not shown) which drives the impeller 12. The inlet side of the impeller 12 is partially closed by an annular plate 24 which is fixed to the outermost portion of the edges of the impeller blades 18. A cylindrical sleeve 26 extends from near the inner edge of the annular plate 24 in an axial direction away from the impeller.

The casing 14 comprises a rear wall 28 and side walls 30 integral with the rear wall 28 and arranged to define two co-axial spiral channels 32 whose innermost ends communicate with a central space in which the impeller 12 is located. The open side of the casing 14 is closed by means of a wear plate 34 which is fixed to the casing 14 and which has a central inlet opening 36 through which the sleeve 26 of the impeller 12 extends. The clearance between the rear surface of the wear plate 34 and the surface of the annular plate 24 is small, for example, approximately 0.4 mm (0.015 inch).

A shroud 38 is mounted on the wear plate 34 around the inlet opening 36. The shroud 38 comprises two radially spaced cylindrical portions joined together at their ends remote from the impeller by an annular portion so as to form an annular channel 40. The shroud has a flange 38 extending radially outwards from the end of the outer cylindrical portion adjacent the impeller. The flange, which forms the outer edge of the shroud 38, is trapped between the wear plate 34 and a wall 44 forming part of the inlet port 46 of the pump 10. The inlet port 46 may be closed by means of a rubber flap valve 48. The channel 40 receives the free end of the impeller sleeve 26. The inner cylindrical portion 42 of the shroud extends into the sleeve 26. The dimensions of the channel 40 are such that the clearance between the channel walls and the sleeve 26 is greater than the clearance between the rear surface of the wear plate 34 and the annular plate 24. Typically the clearance may be of the order of 1.5 mm (0.060 inch).

In use the impeller 12 is driven by means of a motor so that it rotates about the shaft 22 in the direction indicated by the arrow A in FIG. 2. As the impeller 12 rotates, the blades 18 sweep the water or slurry in the impeller 12 outwards creating suction in the central open portion 20 of the impeller 12. This suction draws water or slurry through the inlet port 46 and then in a direction parallel to the axis of the impeller 12 through the impeller sleeve 26. The blades 18 sweep the water or slurry out into the spiral channels 32 of the casing 14 into the outer shell 47 of the pump and out through an outlet port 49 of the pump 10.

Although the rotation of the impeller 12 tends to force the slurry outwards, a certain amount of slurry leaks back towards the centre of the impeller 12 between the annular plate 24 and the wear plate 34 due to the pressure difference across the seal. This leakage reduces the efficiency of the pump and, as described above, may prevent the pump being self-priming.

Initially the clearance between the wear plate 34 and the annular plate 24 is sufficiently small, effectively to form a seal which helps to prevent the leakage of slurry back towards the centre of the impeller. The invention is designed to prevent this seal rapidly becoming worn and ineffective when pumping gritty medium. The seal is further protected by the shroud 38 which prevents the slurry drawn in by the pump flowing over the outside of the impeller sleeve 26 and between the sealing surfaces of the annular plate 24 and wear plate 34.

Any grit or sand drawn in through the pump inlet port 46 is forced outwards by the blades 18 without being ground into the edge of the wear plate 34 which is protected by the sleeve 26 and annular plate 24. Since the sleeve 26 and annular plate 24 are fixed relative to the impeller blades 18, grit or sand cannot be ground between them and there is little wear to the edge of the plate 24.

Ideally, the central opening of the annular plate 24 and the internal diameter of the shroud 38 are the same so that slurry drawn into the centre of the shroud 38 passes straight into the centre of the impeller 12. The pressure difference between the casing 14 and the pump inlet 46 tends to oppose the flow of grit-containing slurry from the inlet 46 to the casing 14 through the convoluted path defined by the shroud 38 and the impeller sleeve 26. Since the grit contained in the slurry is heavier than water, the action of the blades 18 throws the grit clear of the edge of the annular plate 24. As a result, any water seeping back between the annular plate 24 and the wear plate 34 will be relatively free of grit or sand and will cause little damage to the wear plate 34. Furthermore, due to the small separation of the sealing surfaces, any grit or sand which does find its way into the seal will tend to rotate with the annular plate 24 and will be thrown clear at the outer edge of the annular plate 24 as a result of the large centrifugal force which exists at this radius.

If the edge of the wear plate 34 around the inlet opening 36 were to become worn away, the clearance between the annular plate 24 and the wear plate 34 would increase so that eventually, so much water would leak back between the two plates 24 and 34 that the pump 10 could not create sufficient suction to draw water or slurry into the impeller 12 when the pump is started up.

By constructing the pump as described above, grit and sand are prevented from entering between the sealing surfaces of the impeller and casing and thus wear is prevented or reduced.

Since one of the sealing surfaces is formed by the wear plate 34, the impeller 12 can easily be interchanged with a conventional open impeller. Consequently a single pump can be used with the modified impeller described above to pump slurries of grit or sand or with a conventional open impeller to pump stringy material or sewage. The particular form of impeller 12 and shroud 38 described and shown in FIGS. 1 to 3 can be fitted to an existing pump casing.

Figure 4:
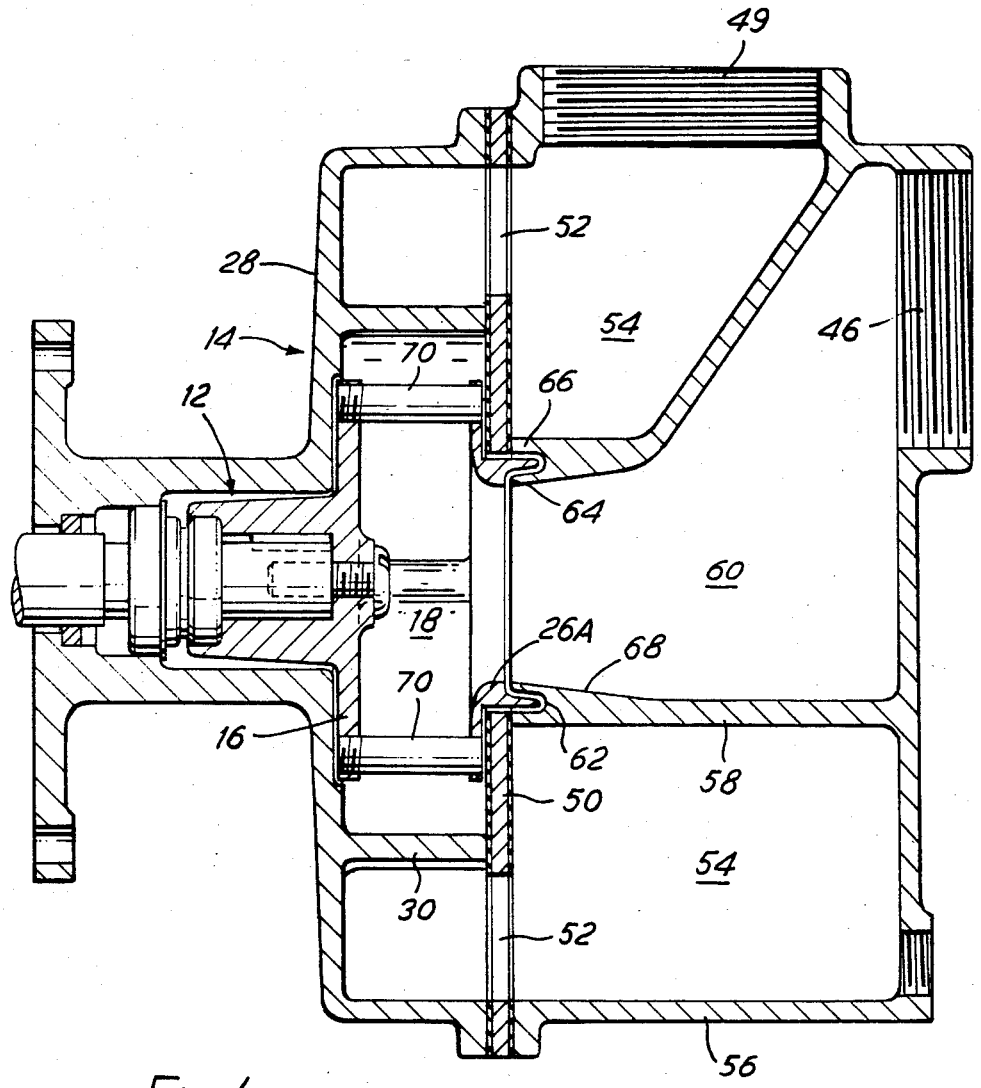
FIG. 4 is a cross-section taken along the axis of a second centrifugal pump in accordance with the invention.

FIG. 4 is similar to FIG. 1 but shows a modified shroud arrangement. Those parts of the pump shown in FIG. 4 which correspond to parts shown in FIG. 1 have been given the same reference numerals.

In the pump of FIG. 4 the annular plate 24 and impeller sleeve 26 are moulded integrally with the impeller blades 18 and rear plate 26. The open side of the volute casing 14 is closed by a wear plate 50. The wear plate 50 has a central opening which forms the casing inlet and further openings 52 through which the volute 14 communicates with an annular outlet chamber 54 which in turn communicates with an outlet port 49. The wear plate 50 is faced on both surfaces with rubber which forms a gasket where the wear plate 50 is in sealing contact with the volute casing 14.

The wear plate 50 is clamped between the volute casing 14 and an outer casing 56 which has an inlet port 46 and an outlet chamber 54. Integral with the outer casing 56 is a tapering duct 58 which extends from around the inlet port 46 to an inner end adjacent the wear plate 50 and which forms an inlet chamber 60 at the middle of the annular outlet chamber 54. The inner end 68 of the duct 58 is shaped to form the shroud which protects the seal between the impeller and the casing. The end 68 has a thicker wall than the rest of the duct and an annular groove 62 in its end surface which receives the end of the impeller sleeve 26. The groove 62 receives the end of the impeller sleeve 26 which is furthest from the impeller 12. The portion 66 of the inner end 68 which lies outside the impeller sleeve 26 bears against the wear plate 50. The rubber facing on the wear plate 50 acts as a gasket to form a seal between inlet chamber 60 and outlet chamber 54.

As described in relation to FIG. 1, the clearance between the annular plate 24 of the impeller 12 and the wear plate 50 is very small and the dimensions of the groove 62 are such that the clearance between the wall of the groove 62 and sleeve 26 is greater. The annular plate 24 and the wear plate 50 form a seal which impedes the flow of slurry or other medium being pumped back towards the central open portion 20 of the impeller 12 between the impeller 12 and the wear plate 50. Slurry being drawn into the pump through the inlet port 46 can only reach the seal surfaces by way of the convoluted pathway defined by the groove 62 formed in the wall 58 and the impeller sleeve 26.

The impeller sleeve 26 also functions as described above to prevent the wear plate 50 becoming excessively worn. If the wear plate 50 does eventually become too worn to form an effective seal with the annular plate 24 it can easily be replaced, even by an unskilled person, as all that is required is to remove the outer casing 56 to release the wear plate 50.

The impeller 12 and volute casing 14 in the pumps shown in FIGS. 1 and 4 are made of synthetic rubber or plastics moulded onto a steel reinforcing member. Where the pump is used to pump slurries of abrasive material that radially outermost trailing edges of the impeller blades 18 and the radially innermost edges of the spiral walls 30 of the volute casing 64 are particularly prone to wear. In order to protect the aforesaid edges, the pump incorporates separate protective members of steel which shield the edges from contact with the abrasive slurry.

Figure 5:
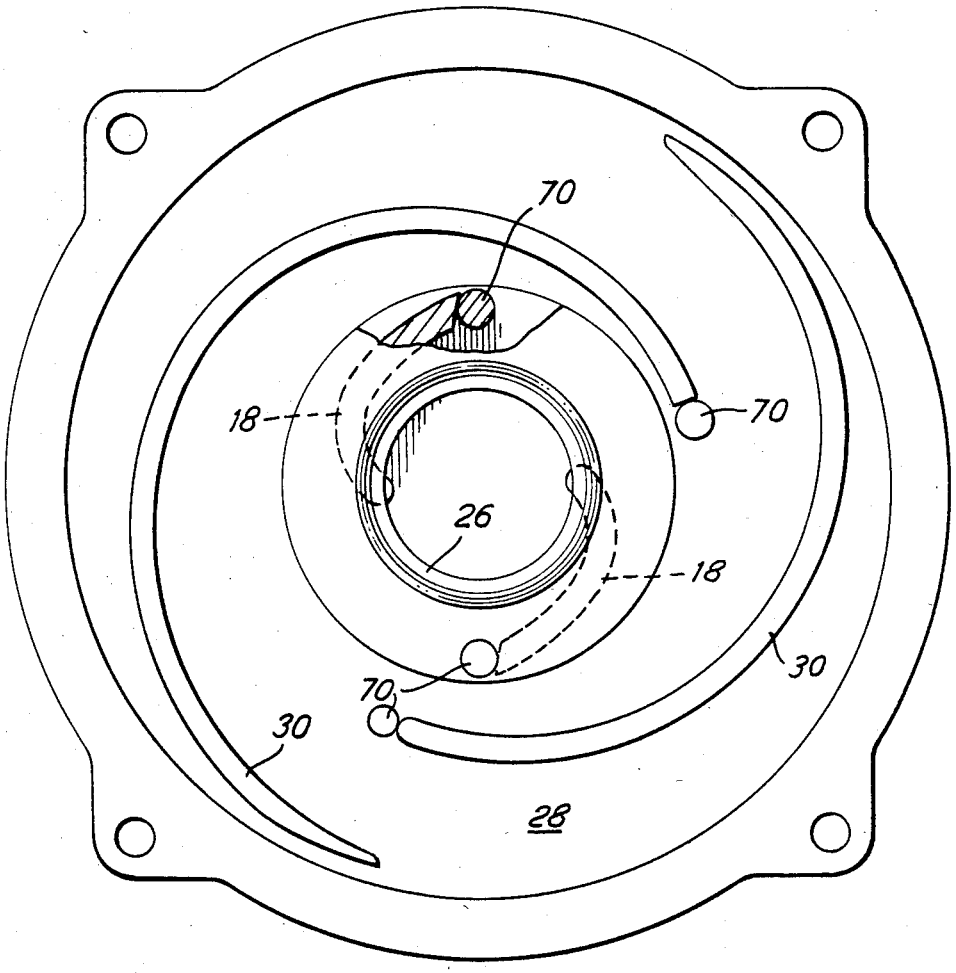
FIG. 5 is a view from an axial direction showing a further modification of the pump of FIG. 4.

As shown in FIG. 5, the protective members take the form of cylindrical steel pins 70 which abut the radially outermost trailng edges of the impeller blades 18 and the radially innermost edges of the spiral walls 30 of the volute casing 14. The pins 70 screw into the rear plate 16 of the impeller 12 or of the volute casing 14 so that, when they become worn, they can easily be removed and replaced.

What we claim is:

1. A centrifugal pump comprising a pump casing having a wall, an inlet opening in said wall and an outlet opening in said wall, an impeller mounted for rotation within said pump casing and having an opening at one side facing said inlet opening, an annular plate mounted to said impeller at said one side, a first radially-extending annular sealing surface on the inside of said casing wall surrounding said inlet opening, a second radially-extending annular sealing surface on said annular plate opposite to said first sealing surface, said first and second sealing surfaces defining radially disposed spaced parallel planer surfaces rotatable relative to each other and defining a radially-disposed annular gap uniform width between said casing wall and said impeller and a tubular sleeve extending from said annular plate through said inlet opening and located radially inwardly of said sealing surfaces, said tubular sleeve defining with said inlet opening an axially-disposed annular gap between said tubular sleeve and said inlet opening in communication with the inner end of said radially-disposed annular gap; the impeller being operable to draw medium being pumped the casing through said tubular sleeve and said impeller opening and discharge it through said annular gap casing outlet, the gap between said relatively rotating surfaces of the impeller and casing wall being such that when the pump is in operation, a continuous rotating film of media is maintained between the surfaces thereof which impedes the flow of media radially inwardly between said impeller and said casing while permitting discharge of any particles of grit or abrasive material. entrained in the media.

2. A centrifugal pump according to claim 1 wherein said impeller comprises a plurality of curved blades disposed about the center of rotation with their trailing ends radiating outwardly with respect to their leading ends relative to the center of rotation and shielding means positioned adjacent the trailing ends.

3. A centrifugal pump according to claim 2 wherein the shielding means comprises cylindrical rod extending substantially parallel to the axis of rotation of the impeller.

4. A centrifugal pump according to claim 2 wherein said pump casing comprises curved walls disposed about the center of rotation of the impeller defining with the impeller blades diffuser passages extending outwardly from the impeller within said casing and shielding means adjacent the radially-innermost ends of said walls, said shielding means being in the form of cylindrical rods extending substantially parallel to the axis of rotation of the impeller.

5. The invention according to claim 3 wherein said shielding means is of steel.

6. The invention according to claim 3 wherein the axial dimension of said shielding means is substantially equal to the axial depth of said adjacent impeller blade.

7. The invention according to claim 1 further comprising shroud means surrounding said inlet aperture and extending over the end of the sleeve remote from said impeller to impede the flow of medium between said casing and said sleeve.

8. The invention according to claim 7 wherein said shroud means has a re-entrant portion which extends into the sleeve towards said impeller.

9. The invention according to claim 8 wherein said re-entrant portion comprises a first cylindrical portion, and wherein said shroud means includes a second cylindrical portion and an annular portion; said first and second cylindrical portions lying respectively inside and outside said sleeve and being joined at their ends remote from said impeller by said annular portion.

10. The invention according to claim 8 wherein the internal diameter of said re-entrant portion of said shroud means is the same as the diameter of the radially innermost edge of said annular plate.

11. The invention according to claim 8 including a tubular inlet duct leading to said sleeve; said duct having an annular end surface opposite said sleeve, said end surface having a groove formed therein which forms said shroud and receives the end of said sleeve remote from said impeller.

12. The invention according to claim 11 wherein the cross-sectional area of said tubular duct decreases towards said sleeve.

13. A centrifugal pump comprising a pump casing having a wall, an inlet opening in said wall and an outlet opening in said wall, an impeller mounted for rotation within said pump casing and having an opening at one side facing said inlet opening, said impeller comprising a plurality of curved blades radiating outwardly relative to the center of rotation thereof, an annular plate mounted to said impeller at said one side, a first radially-extending annular sealing surface on the inside of said casing wall surrounding said inlet opening, a second annular sealing surface on said annular plate opposite to and in closely-spaced relation with said first sealing surface and shroud means surrounding said inlet opening and having a lip portion directed into said inlet opening toward said impeller, said impeller being operable to draw the medium being pumped into said casing through said shroud means and said impeller opening and discharge it through said casing opening, whereby, when the pump is in operation, a film of medium is held between said sealing surfaces to constitute a seal between the impeller and casing wall and particles of grit or abrasive material in said medium entering between said surfaces are thrown out by way of centrifugal forces, said curved blades having removable shielding means adjacent the trailing end of each blade of said impeller, said removable shielding means being in the form of a cylindrical rod extending substantially parallel to the axis of rotation of the impeller.

14. The invention according to claim 13 wherein said shielding means is of steel.

15. The invention according to claim 13 wherein the axial dimension of said shielding means is substantially equal to the axial depth of said adjacent impeller blade.

16. The invention according to claim 13 wherein said shielding means includes first securing means and the impeller includes a web portion; the web portion of said impeller including second securing means adjacent said tip of each said impeller blade; said first and second securing means being engageable to secure said shielding means to said impeller.

17. A centrifugal pump according to claim 13 wherein said pump casing comprises walls disposed about the center of rotation of the rotor to define, in conjunction with the blades, spiral diffuser passages extending outwardly from said impeller within said casing and wherein there is shielding means adjacent the radially innermost ends of said walls.

18. A centrifugal pump according to claim 17 wherein said shielding means at the radially innermost ends of said walls are in the form of cylindrical rods extending substantially parallel to the axis of rotation of the impeller.

19.

The invention according to claim 13 wherein said lip portion comprises a first cylindrical portion and wherein said shroud means further includes a second cylindrical portion and an annular portion; said second cylindrical portion being concentric with, and surrounding, said first cylindrical portion and said annular portion joining said first and second cylindrical portions at their ends remote from said impeller.

20. The invention according to claim 19 wherein the internal diameter of said lip portion is substantially equal to the diameter of the radially innermost edge of said annular plate.

* * * * *